US007624725B1

(12) United States Patent
Choma

(10) Patent No.: US 7,624,725 B1
(45) Date of Patent: Dec. 1, 2009

(54) CROSSBOW COCKING SYSTEM

(75) Inventor: David A. Choma, Tallmadge, OH (US)

(73) Assignee: Horton Archery, LLC, Tallmadge, OH (US)

( * ) Notice: Subject to any disclaimer, the term of this patent is extended or adjusted under 35 U.S.C. 154(b) by 343 days.

(21) Appl. No.: 11/897,831

(22) Filed: Sep. 4, 2007

(51) Int. Cl.
*F41B 5/12* (2006.01)

(52) U.S. Cl. ..... 124/25

(58) Field of Classification Search ..... 124/25, 124/86

See application file for complete search history.

(56) References Cited

U.S. PATENT DOCUMENTS

| | | | | | |
|---|---|---|---|---|---|
| 3,538,901 | A * | 11/1970 | Switack | ..... | 124/25 |
| 4,603,676 | A * | 8/1986 | Luoma | ..... | 124/25 |
| 5,220,906 | A | 6/1993 | Choma | ..... | 124/25 |
| 5,243,956 | A | 9/1993 | Luehring | ..... | 124/86 |
| 5,823,172 | A | 10/1998 | Suggitt | ..... | 124/25 |
| 6,874,491 | B2 * | 4/2005 | Bednar | ..... | 124/25 |
| 6,913,007 | B2 | 7/2005 | Bednar | ..... | 124/25 |
| 7,100,590 | B2 | 9/2006 | Chang | ..... | 124/25 |
| 2006/0086346 | A1 * | 4/2006 | Middleton | ..... | 124/25 |

OTHER PUBLICATIONS

Publication: Author—Sir Ralph Payne-Gallwey, Bt.; Title: The Crossbow; Date: 1996; Cover page and pp. 121-125.

* cited by examiner

*Primary Examiner*—John Ricci
(74) *Attorney, Agent, or Firm*—Renner, Kenner, Greive, Bobak, Taylor & Weber

(57) ABSTRACT

A system (30) for cocking a crossbow (10) includes two connectors (33) each having a hook (35) adapted to engage a bow string (24) on each side of the stock (11) of the crossbow (10). Each connector (33) includes a pulley (38) which receives a rope (31) therethrough, and also includes at least one laterally extending shoulder (40) which rides against the stock (11) when the crossbow (10) is being cocked. The shoulders (40) thus space the hook (35) and pulley (38) of each connector (33) from the stock (11) so that the trigger safety (20) is not accidentally engaged. A support block (24) is attached to the stock (11) and is provided with a track (49) to receive the rope (31) so that the rope (31) is maintained generally in the same plane as the bow string (24).

17 Claims, 4 Drawing Sheets

CROSSBOW COCKING SYSTEM

TECHNICAL FIELD

This invention relates to a system for cocking a crossbow. More particularly, this invention relates to a rope and pulley/hook cocking system which will maintain the pulley/hooks away from the stock of the crossbow and which is also provided with a rope guiding feature.

BACKGROUND ART

In order to cock a crossbow in preparation for firing the same, the string must be pulled toward a trigger assembly. When such is being accomplished, sufficient force must be exerted to bend the limbs of the crossbow which carry the string. Once the string is engaged by the trigger assembly, the trigger safety is activated. Then an arrow may be loaded in the crossbow with its back end in contact with the string, the trigger safety may be disengaged, and the trigger pulled to release or shoot the arrow.

The force required to cock the crossbow in this fashion has consistently been a problem for the crossbow user. Specifically, despite the use of compound bows with cams that attach the string to the limbs, the force required to cock a typical crossbow often exceeds one hundred pounds. As a result, many devices have been designed to assist in the cocking of a crossbow.

The most sophisticated of these devices is an essentially automatic cocking machine which is attached to the stock of a crossbow and by means of a motorized rope system, the crossbow may be cocked as previously described. In lieu of being motorized, these cocking devices can also be operated by means of a hand crank. While these automatic or hand cranked devices operate satisfactorily, they are somewhat expensive, add additional weight, and they are bulky when attached to the stock of the crossbow.

A more traditional and less expensive cocking system is shown, for example, in U.S. Pat. No. 5,243,956. In this type of system, a connector which includes a hook and a pulley, is hooked onto the string on each side of the stock of the crossbow. A rope is received around one pulley, around the butt end of the stock, and around the other pulley. The rope is then pulled at both ends to draw the string and cock the crossbow.

While this system enables one to more easily cock a crossbow than could be accomplished totally manually, it is not without its problems. For example, as the string is being drawn, the connectors will tend to ride heavily against the sides of the crossbow stock. Such not only adds friction to the cocking process, but also, more significantly, the connectors can often engage the trigger safety to activate the same before the string reaches the trigger. Such will then prevent the string from being engaged by the trigger or will give the user the false sense that the string has been engaged. In addition, the rope is not guided as it passes over the butt end of the stock, and because the butt end of the stock of a crossbow is usually not on the same plane as the bow string, the rope can easily slip off of that end.

As a result, the need exists for a crossbow cocking system which is affordable and yet which is not plagued with the problems of the prior art systems.

DISCLOSURE OF THE INVENTION

It is thus an object of one aspect of the present invention to provide a rope cocking crossbow system in which the connectors will not deleteriously interfere with or otherwise engage components of the crossbow.

It is an object of another aspect of the present invention to provide a system, as above, in which the rope is guided at the area opposed to the engagement of the connectors with the string.

These and other objects of the present invention, as well as the advantages thereof over existing prior art forms, which will become apparent from the description to follow, are accomplished by the improvements hereinafter described and claimed.

In general, in accordance with one aspect of the invention, a system for cocking a crossbow having a stock which carries a string includes a first connector adapted to engage the string on one side of the stock. A second connector is adapted to engage the string on the other side of the stock. Each connector has a hook portion to engage the string, a pulley portion, and a laterally outwardly extending shoulder. A rope is received around the pulley portions of the connectors. The shoulders maintain the hook and pulley portions spaced from the stock during cocking of the crossbow.

In accordance with another aspect of the invention, a system for cocking a crossbow having a stock which carries a string includes a first connector adapted to engage the string on one side of the stock. A second connector is adapted to engage the string on the other side of the stock. Each connector has a hook portion to engage the string and a pulley portion. A rope is received around the pulley portions of the connectors. A support block is carried by the stock and has a track which is positioned generally in the same plane as the string. The track receives a portion of the rope located between the pulleys.

In another aspect of the invention, a system for cocking a crossbow having a stock which carries a string includes a first connector adapted to engage the string on one side of the stock. A second connector is adapted to engage the string on the other side of the stock. Each connector has a hook portion to engage the string, a pulley portion, and a laterally outwardly extending shoulder. The shoulders maintain the hook and pulley portions spaced from the stock during cocking of the crossbow. A rope is received around the pulley portions of the connectors. A support block is carried by the stock and has a track which is positioned generally in the same plane as the string. The track receives a portion of the rope located between the pulleys.

A preferred exemplary rope crossbow cocking system according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
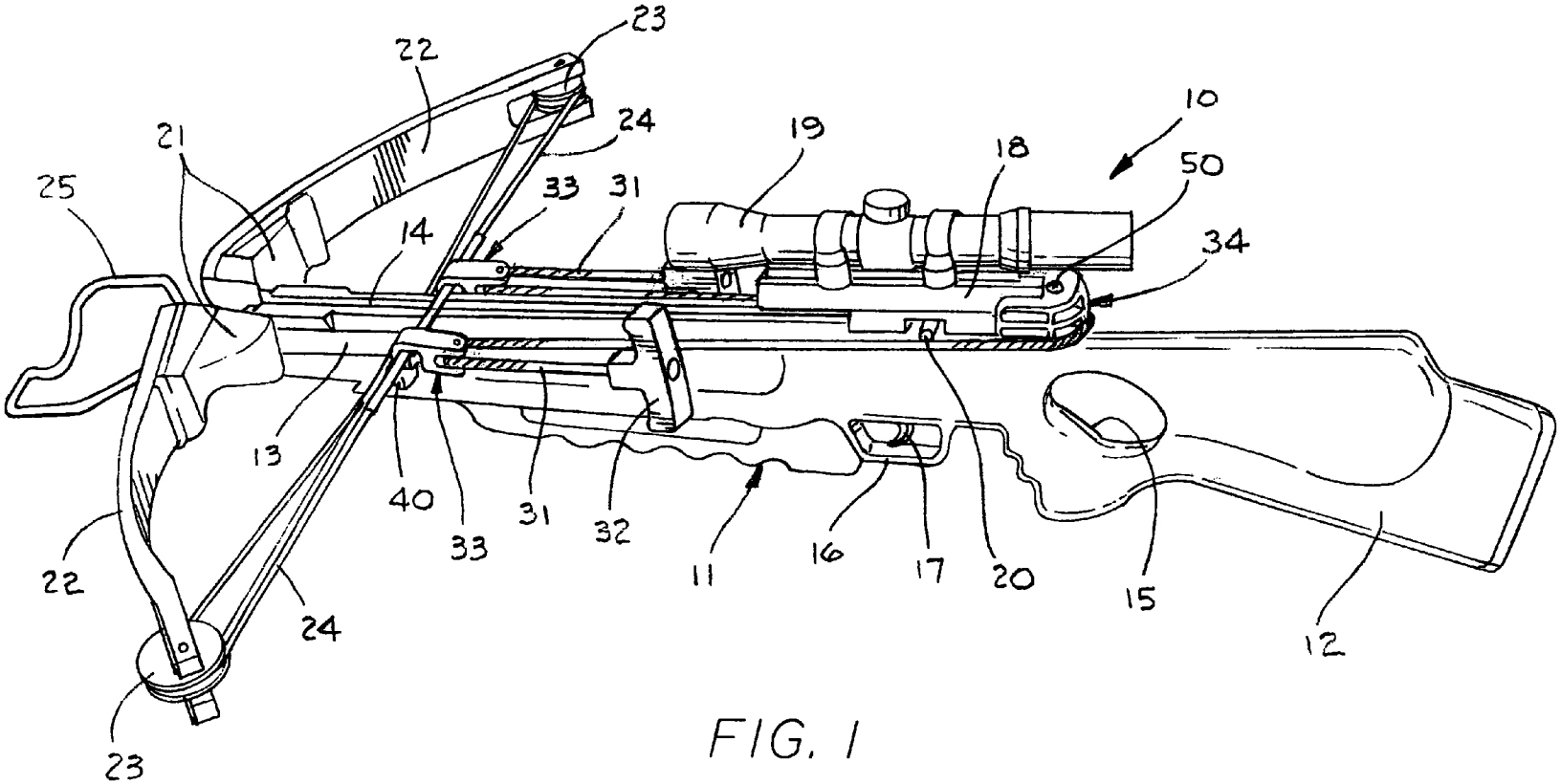
FIG. 1 is a somewhat schematic perspective view of a crossbow shown in association with a cocking system of the present invention.

A substantially conventional crossbow is generally indicated by the numeral 10 and includes a stock generally indicated by the numeral 11. Stock 11 can take on numerous configurations but basically includes a butt end 12 and a barrel end 13. The barrel end 13 has a slot 14 formed in the top thereof to receive an arrow. Stock 11 can also be provided with a thumbhole 15 and a trigger guard 16 extending around a pull trigger 17. A sight mounting block 18 may be positioned on top of stock 11 at the rear end of slot 14. Sight block 18 carries a sight 19 and also at the location of block 18, a trigger safety 20 may extend laterally from block 18 and stock 11. Safety 20 is slid in one direction during the cocking process to prevent trigger 17 from firing the crossbow 10, and when the crossbow is ready to be fired, it is moved manually to enable trigger 17.

The front of barrel end 13 of stock 11 carries a riser 21 which extends laterally from each side of barrel end 13. Opposed limbs 22 each have one end attached to riser 21 and their other ends are provided with wheels or cams 23 around which are received the string 24 of the crossbow 10. A cocking stirrup 25 is also provided at the front end of barrel end 13 of stock 11.

If crossbow 10 were to be manually cocked, the end of stirrup 25 would be placed on the ground and the user would put his foot in it. Then the user would bend down, with his chest generally against the butt end 12 of the stock 11, and grab and pull the string 24 longitudinally rearwardly against the force of the bending limbs 22 until the string 24 would be engaged by the trigger 17 assembly. The engagement of the string 24 with the trigger 17 automatically activates the safety 20, moving it to the right as shown in FIG. 1. An arrow is then placed in slot 14 with its rear end in contact with the string 24, and after trigger safety 20 is manually released, the crossbow 10 may be fired. As previously described, this process can require a great deal of force that many users cannot readily provide.

The present invention includes a cocking system, generally indicated by the numeral 30, which renders the cocking of crossbow 10 much easier and simpler. The components of system 30 include a rope 31 or equivalent device, handles 32, hook/pulley connectors generally indicated by the numeral 33, and a support block generally indicated by the numeral 34.

Figure 4:
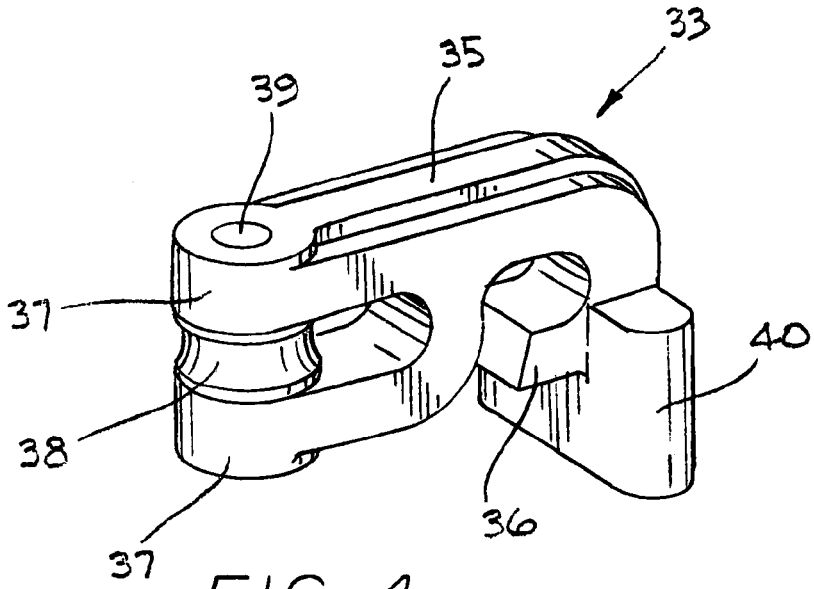
FIG. 4 is a perspective view of a pulley/hook connector component of the cocking system.

As best shown in FIG. 4, each connector assembly 33 may be made of a suitable plastic material and includes a longitudinally extending body portion 35 having a hook 36 formed at one end. The other end of body portion is bifurcated to form two opposed jaws 37 which rotatably carry a pulley 38 therebetween. Each pulley is thus rotatable on a vertical axis 39. A shoulder 40 extends laterally outward from each side of hook 36. As shown, shoulders 40 do not extend the entire height of connectors 33 but rather only extend to the approximate height of the bottom of the opening of hook 36 and to the height of the lower jaws 37.

Figure 5:
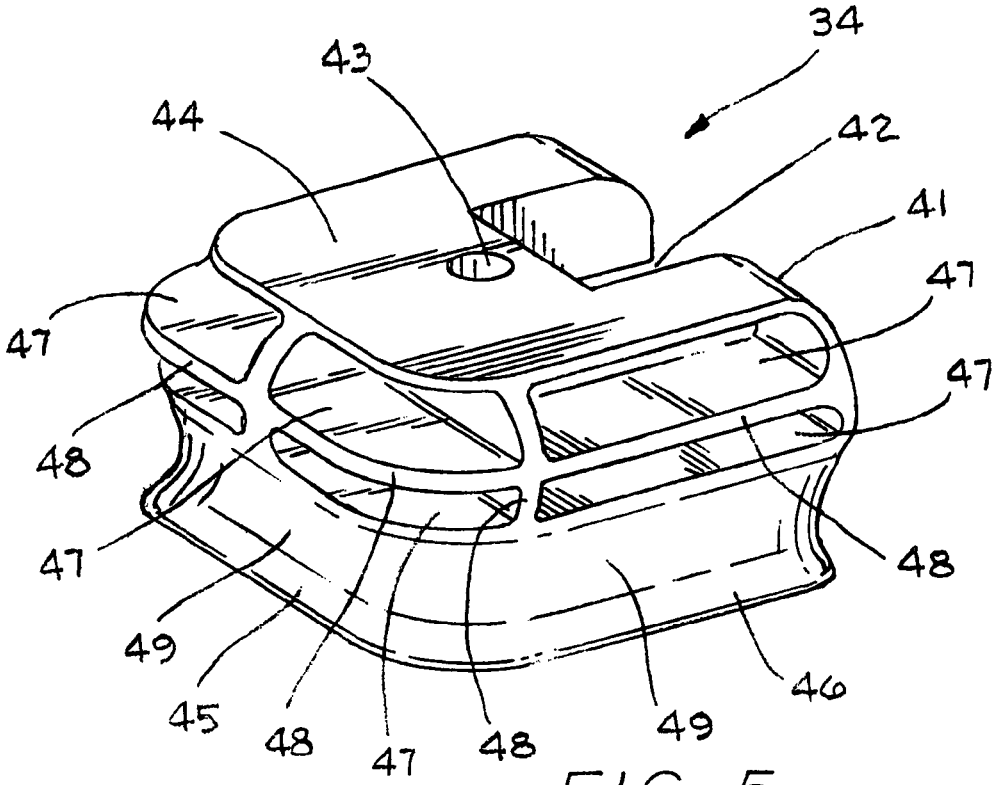
FIG. 5 is a perspective view of a support block component of the cocking system.

Support block 34, which may also be made of any suitable plastic material, is shown in FIG. 5 and includes a front wall 41 having a slot 42 therein which extends under an aperture 43 in the top wall 44 of block 34. Block 34 also includes a rear wall 45, and opposed side walls 46 extend from rear wall 45 to front wall 41. The upper portion of walls 45 and 46 are provided with a honeycomb-like system of openings 47 and ribs 48 to reduce the weight of block 34 while at the same time maintaining its strength. A continuous track 49 is formed near the bottom of each wall 45, 46 and thus extends along one side wall 46, around rear wall 45, and along the other side wall 46. The bottom of track 49 is preferably curved to match the radius of curvature of rope 31.

Block 34 is adapted to be attached to crossbow 10 so that track 49 is generally in the same plane as crossbow string 24. To that end, a convenient place to mount block 34 is at the end of sight block 18. Thus, as shown in FIG. 1, the end of sight block 18 is positioned in slot 42 of block 34, and a fastener 50 may be received through aperture 43 and into sight block 18 to secure block 34 to crossbow 10.

In order to assembly cocking system 30, the rope 31, which may be attached to one of the handles 32, as by a knot 51, is threaded between the jaws 37 of connectors 33 and attached to the other handle 32 as by a knot 51. It should be noted that the knot connections provide a facile means by which the total length of rope 31 may be adjusted as may be necessary dependent on the dimensions of the crossbow 10 to be cocked.

Figure 2:
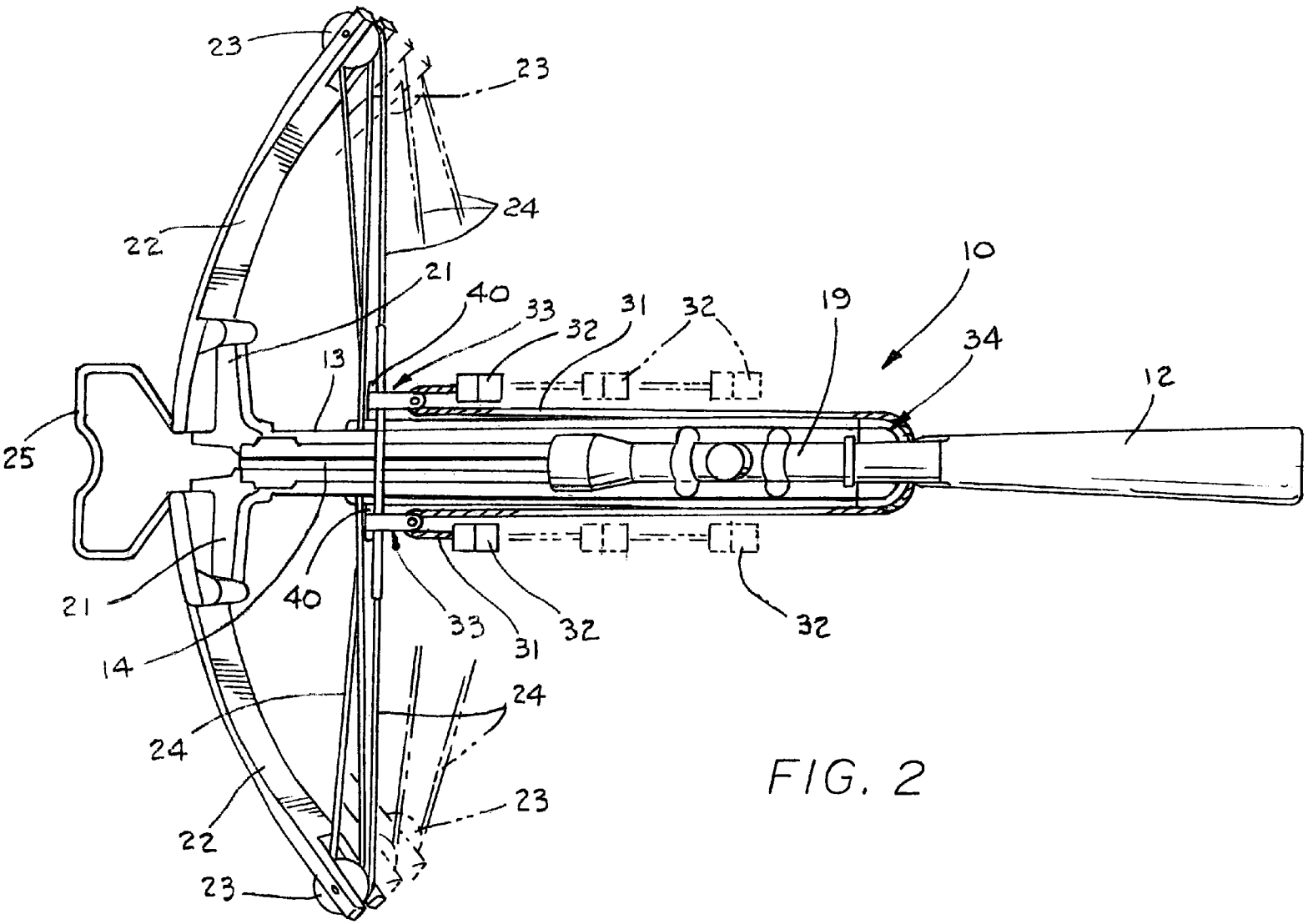
FIG. 2 is a somewhat schematic plan view of the crossbow showing the cocking procedure.
Figure 3:
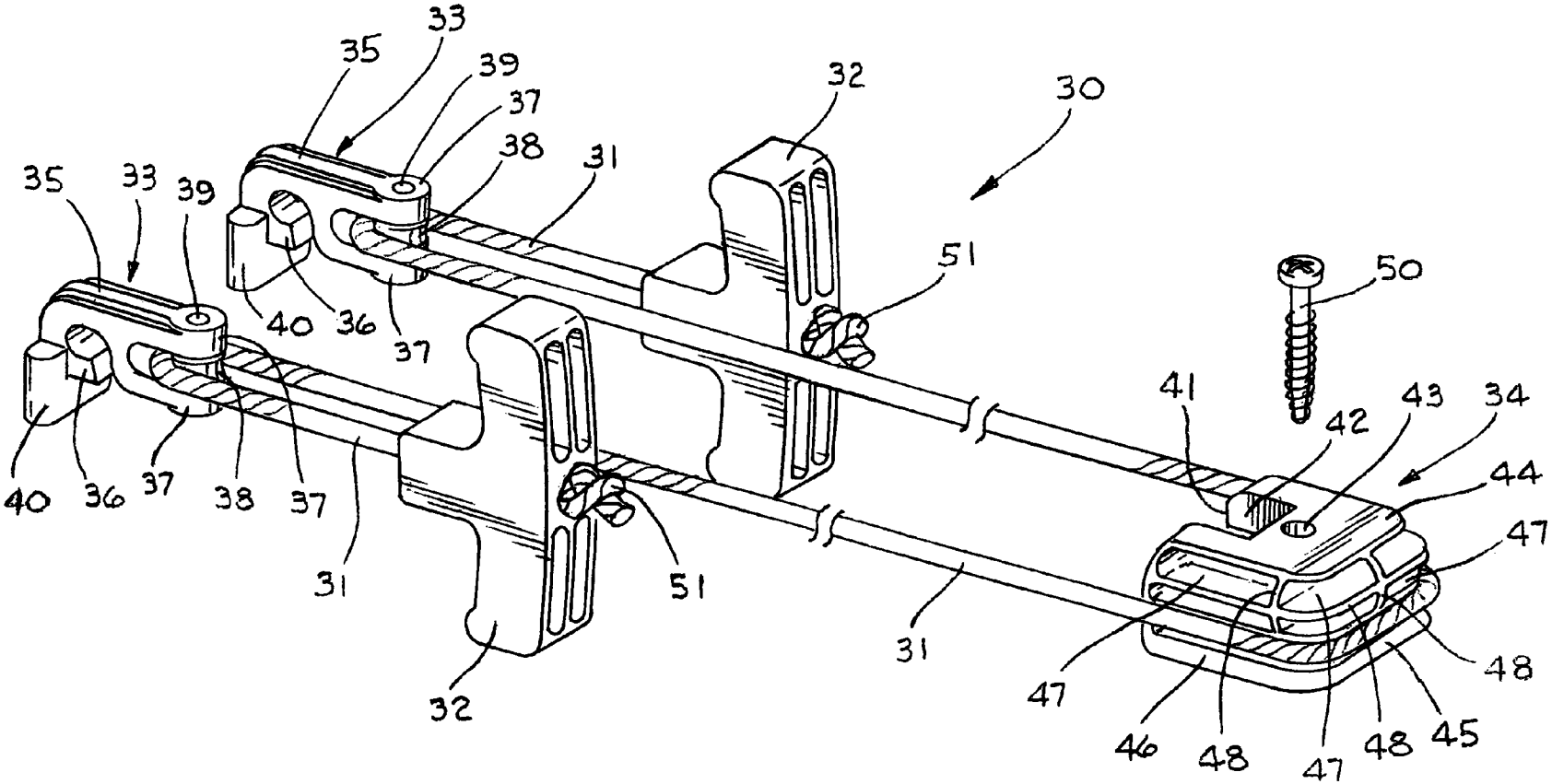
FIG. 3 is a perspective view of a crossbow cocking system made in accordance with the present invention.

Once assembled, the manner in which the system 30 is used to cock a crossbow is as follows: The hooks 36 of connectors 33 are positioned to engage the bow string 31 with one hook being on each side of stock 11 as shown in FIG. 1. The rope 31 between the handles 32 is looped around support block 34 and positioned in track 49. Block 34 thus generally defines and dictates the distance between the rope portions, and as previously described, by virtue of track 49, rope 31 is generally in the same plane as bow string 24. Then as the user pulls on handles 32, limbs 22 begin to flex as shown in FIG. 2. During this operation, those shoulders 40 of connectors 33 which are positioned adjacent to the stock 11 will ride against the stock providing minimal frictional resistance. Importantly, as the connectors 33 pass by the trigger safety 20, it will not be engaged by a connector 33 because the safety 20 will pass above the shoulder 20. Thus, the shoulders 40 of connectors 33 maintain the body 35 of connectors 33 spaced from the stock 11 of the crossbow 10. During this operation, the rope 31 is maintained in track 49 of block 34 not only because the track 49 is radiused similar to rope 31, but also because it is aligned with string 24 assuring a straight line movement.

It should also be noted that although only one shoulder 40 of each connector 33 is involved in the function of avoiding contact with the safety 20, each connector 33 is preferably provided with two shoulders 40 so that the connectors are rendered interchangeable during the assembling process.

In view of the forgoing, it should be evident that a crossbow rope cocking system 30 as described herein accomplishes the objects of the present invention and otherwise substantially improves the art.

What is claimed is:

1. A system for cocking a crossbow having a stock carrying a string comprising a first connector adapted to engage the string on one side of the stock; a second connector adapted to engage the string on the other side of the stock; each said connector having a hook portion to engage the string, a pulley portion, and a laterally outwardly extending shoulder; and a rope received around said pulley portions of said connectors; said shoulders maintaining said hook and pulley portions spaced from the stock during cocking of the crossbow.

2. The system of claim 1 further comprising a support block carried by the stock, said support block having a track positioned generally in the same plane as the string to receive a portion of said rope located between said pulleys.

3. The system of claim 2 wherein a sight block is attached to the stock and said support block is adapted to be attached to the sight block.

4. The system of claim 3 wherein said support block includes a slot adapted to receive the sight block.

5. The system of claim 1 wherein each said connector includes a second shoulder extending laterally outward in a direction opposite to said shoulder.

6. The system of claim 1 wherein said hook portions and said pulley portions have a height, each said shoulder having a height less than the height of said hook and pulley portions.

7. The system of claim 1 further comprising a handle connected to each end of said rope.

8. A system for cocking a crossbow having a stock carrying a string comprising a first connector adapted to engage the string on one side of the stock; a second connector adapted to engage the string on the other side of the stock; each said connector having a hook portion to engage the string and a pulley portion; a rope received around said pulley portions of said connectors; and a support block carried by the stock, said support block having a track positioned generally in the same plane as the string to receive a portion of said rope located between said pulleys.

9. The system of claim 8 wherein a sight block is attached to the stock and said support block is adapted to be attached to the sight block.

10. The system of claim 9 wherein said support block includes a slot adapted to receive the sight block.

11. The system of claim 8 wherein said hook portions and said pulley portions have a height, each said shoulder having a height less than the height of said hook and pulley portions.

12. The system of claim 8 further comprising a handle connected to each end of said rope.

13. The system of claim 8 wherein said support block includes a plurality of openings and ribs above said track.

14. The system of claim 8, each said connector including at least one shoulder adapted to engage the stock and maintain said hook portion and said pulley portion spaced from the stock.

15. The system of claim 14 wherein said hook portions and said pulley portions have a height, each said shoulder having a height less than the height of said hook and pulley portions.

16. The system of claim 14 wherein each said connector includes a second shoulder extending laterally outward in a direction opposite to said shoulder.

17. A system for cocking a crossbow having a stock carrying a string comprising a first connector adapted to engage the string on one side of the stock; a second connector adapted to engage the string on the other side of the stock; each said connector having a hook portion to engage the string, a pulley portion, and a laterally outwardly extending shoulder; said shoulders maintaining said hook and pulley portions spaced from the stock during cocking of the crossbow; a rope received around said pulley portions of said connectors; and a support block carried by the stock, said support block having a track positioned generally in the same plane as the string to receive a position of said rope located between said pulleys.

* * * * *